United States Patent [19]

Pardes et al.

[11] 4,137,651

[45] Feb. 6, 1979

[54] MOVING TARGET PRACTICE FIRING SIMULATOR

[75] Inventors: Herman Pardes, Wanamassa; Frederick B. Sherburne, Oceanport; Joseph R. Schwartz, Toms River, all of N.J.

[73] Assignee: The United States of America as represented by the Secretary of the Army, Washington, D.C.

[21] Appl. No.: 907,369

[22] Filed: May 19, 1978

Related U.S. Application Data

[63] Continuation of Ser. No. 728,331, Sep. 30, 1976, abandoned.

[51] Int. Cl.[2] ..... F41G 3/26; F41J 9/00

[52] U.S. Cl. ..... 35/25; 273/101.1; 273/102.2 B

[58] Field of Search ..... 35/12 N, 25; 273/101.1, 273/102.2 B, 102.1 C; 352/39, 70

[56] References Cited

U.S. PATENT DOCUMENTS

| | | | |
|---|---|---|---|
| 2,406,574 | 8/1946 | Waller et al. | 35/25 |
| 2,418,512 | 4/1947 | Johnson | 35/25 |
| 3,549,147 | 12/1970 | Katter | 273/101.1 |
| 3,838,856 | 10/1974 | Takeya et al. | 35/25 |
| 3,888,022 | 6/1975 | Pardes et al. | 35/25 |
| 3,895,861 | 7/1975 | Herndon | 35/12 N X |

*Primary Examiner*—Vance Y. Hum

*Attorney, Agent, or Firm*—Nathan Edelberg; Jeremiah G. Murray; Edward Goldberg

[57] ABSTRACT

An electro-optical system for weapons training, consisting of a low-power eye-safe laser beam simulating the weapon's fire, a realistic moving target scene projected by a moving picture projector or slide projector onto a screen, a laser beam hit detector based upon a second projector, and a display board for displaying the hits and attempts of each trainee. Multi-station operation is accomplished by a digitally multiplexed time sharing system which allows each laser beam to fire only during a discrete time interval regulated by encoder pulses transmitted by radio. The laser beam detector is synchronized with the film of the target projector and acts as an annotated mask, this mask being opaque except for transparent areas corresponding to the target areas projected by the projector. A properly aimed laser beam will pass through the transparent area of the mask and be counted as a hit by the hit detector.

9 Claims, 9 Drawing Figures

MOVING TARGET PRACTICE FIRING SIMULATOR

The invention described herein may be manufactured and used by or for the Government for governmental purposes without the payment of any royalties thereon or therefor.

This is a continuation, of application Ser. No. 728,331, filed Sept. 30, 1976, now abandoned.

BACKGROUND OF THE INVENTION

In U.S. Pat. No. 3,888,022 there is described a screen upon which is projected a movie picture having scenes with moving targets. That invention provides a reasonably realistic and accurate method to test and practice weapon marksmanship and tactics training. That invention provided moving targets which are projected onto a small indoor screen from a motion picture film and substituted low-power laser beams aligned with the weapon barrel for the use of live ammunition. The trainees aimed their weapons and "fired" the laser beams at the targets shown on the screen. That invention allowed a squad of men to train together inexpensively and without danger and eliminated any need for wires extending beyond the weapons themselves.

SUMMARY OF THE INVENTION

The present invention comprises a laser module which is temporarily and removably attached to a weapon and which is "fired" by the trainee at a projected image of a moving target in lieu of live ammunition. The target is projected by a commercially available movie or slide projector and may consist, for example, of a 15-minute continuous film providing realistic scenes of moving and stationary targets of a type normally engaged by small arms, machine guns, or anti-tank weapons. The moving target is projected onto a large curved screen through an anamorphic lens, thus providing a "panoramic" effect. The screen also images the laser beam fired by the operator onto a laser beam hit detector assembly which utilizes a second projector which is modified for this purpose. The detector assembly contains a second reel of film which is exactly synchronized with the film projecting the target scene. The film of the detector assembly is an opaque annotated mask with clear spots corresponding to the target positions on the projected target scene. The mask may be made on the film by animation techniques on a frame-by-frame basis. When the weapon has been properly aimed, the laser radiation, after striking the screen, will be imaged onto the clear spot of the annotated mask.

A laser beam striking a target will activate a laser beam sensitive detector after passing through the clear portion of the mask and will register a hit on a scoring display. A beam hitting off-target will be attenuated by the opaque mask to a signal level which is too low to trigger the laser beam sensitive detector; it will, however, register on a separate wide field attempt detector. The two detectors and their associated amplifiers and threshold circuits are preferably all placed in a package within the laser beam hit detector assembly.

The attempt detector is connected to an audio system as well as to the scoring display, so that every firing of a weapon simulator will be accompanied by realistic sound effects from the audio system. An external closed circuit TV may also be employed to record the scoring displays and to facilitate criticism and training.

If a single weapon is to be used, the hit and attempt detector outputs are displayed on a scoring display. When the trigger of the weapon is pulled, and laser is enabled and will fire. The present invention, however, also permits the use of a number of weapon stations. Each station becomes part of a digitally multiplexed time sharing system wherein a series of pulses synchronized with the projector film advance is generated by an encoder. Each station is pre-assigned a specific clock pulse within each film advance cycle. Using discrete address techniques, the laser on each weapon can be fired only during the time it is enabled. The encoded output can be transmitted using radio frequency techniques to a receiver-decoder at each weapon, or it may be directly connected to the decoder. The use of the RF receiver/transmitter is more flexible since it allows considerably greater freedom of movement by the trainees.

Real-time hit indication is provided to the firer by pulse width discrimination techniques. When the threshold circuit records a hit during a particular clock pulse, that pulse is electronically expanded. The receiver-decoder for that particular simulator recognizes the expanded pulse and provides an indication to the firer by activating a light emitting diode (LED) located behind the rifle sight.

Features and Objectives of the Invention

It is an objective of the present invention to provide a panoramic moving target screen system using two separate synchronized projectors. This allows the use of two independent optical systems, permitting different specialized lens coatings and individual focusing of the target projector and the laser beam detector. Hence, significantly improved resolution of small and distant targets is provided over the prior art. The use of two conventional films, one containing a target image and the other a corresponding annotated mask, rather than one specialized film in which each frame contains both a target and a mask, considerably decreases the cost and complexity of the system.

A further objective of the present invention is to project the moving target scene in color, while the discriminator film is in black and white. This feature decreases system cost as well as improves system differentiation between hits and attempts or spurious random impulses, since a higher wavelength laser may be employed without drastically reducing the opacity of the discriminator mask. This feature permits compatibility with the M16 Man vs. Man/Target Engagement Simulator, the Vehicle Engagement Simulator, and the M60 MG Laser.

It is a further objective of the present invention to obtain more reliable and noise-immune mutliplexing by using frequency shift keying rather than pulsed carrier transmission in the multiplexing RF circuits.

It is a feature of the present invention to provide a weapons training system comprising at least one weapon on which is removably mounted a laser means producing a laser beam. The laser beam is a simulation of the fire of said weapon and is controlled by the operator of said weapon. The system also includes a projection screen, a projector (either a slide projector or a motion picture projector) and a first film, preferably in color, within the projector showing target scenes. The projector projects the target scenes onto the screen and a second film, preferably in black-and-white, which is substantially opaque to radiation from the laser beam except for at least one aperture which is substantially transparent to radiation from said laser beam, is used as a mask. The aperture is placed to correspond with a chosen target area of the target scene film. The system also includes a laser detector, including a photo-detector, containing the second film. The projector and said laser detector have different and independent optical systems with independent focusing. The system includes synchronizing means for advancing the first film synchronously with the second film and hit detector means responsive to reflections of the laser beam from said screen and through the substantially transparent area of the second film.

DESCRIPTION OF THE DRAWINGS

Other features and objectives of the present invention will be apparent from the following detailed description, which description should be taken in conjunction with the accompanying drawings. In the drawings:

FIGS. 2A–2E are timing diagrams illustrating the relative pulse timing of the various components of the system of the present invention, in which:

FIG. 2A illustrates the shutter synchronizing pulses from the projector,

FIG. 2B illustrates the firing gate,

FIG. 2C illustrates the weapon encoder pulses from the weapon position encoder,

FIG. 2D illustrates the radio frequency output pulses transmitted by the R–F transmitter, FIG. 2E illustrates a hit pulse from a specified weapon, by way of example, as detected by the hit detector of the scoring display.

DETAILED DESCRIPTION OF THE INVENTION

Figure 1:
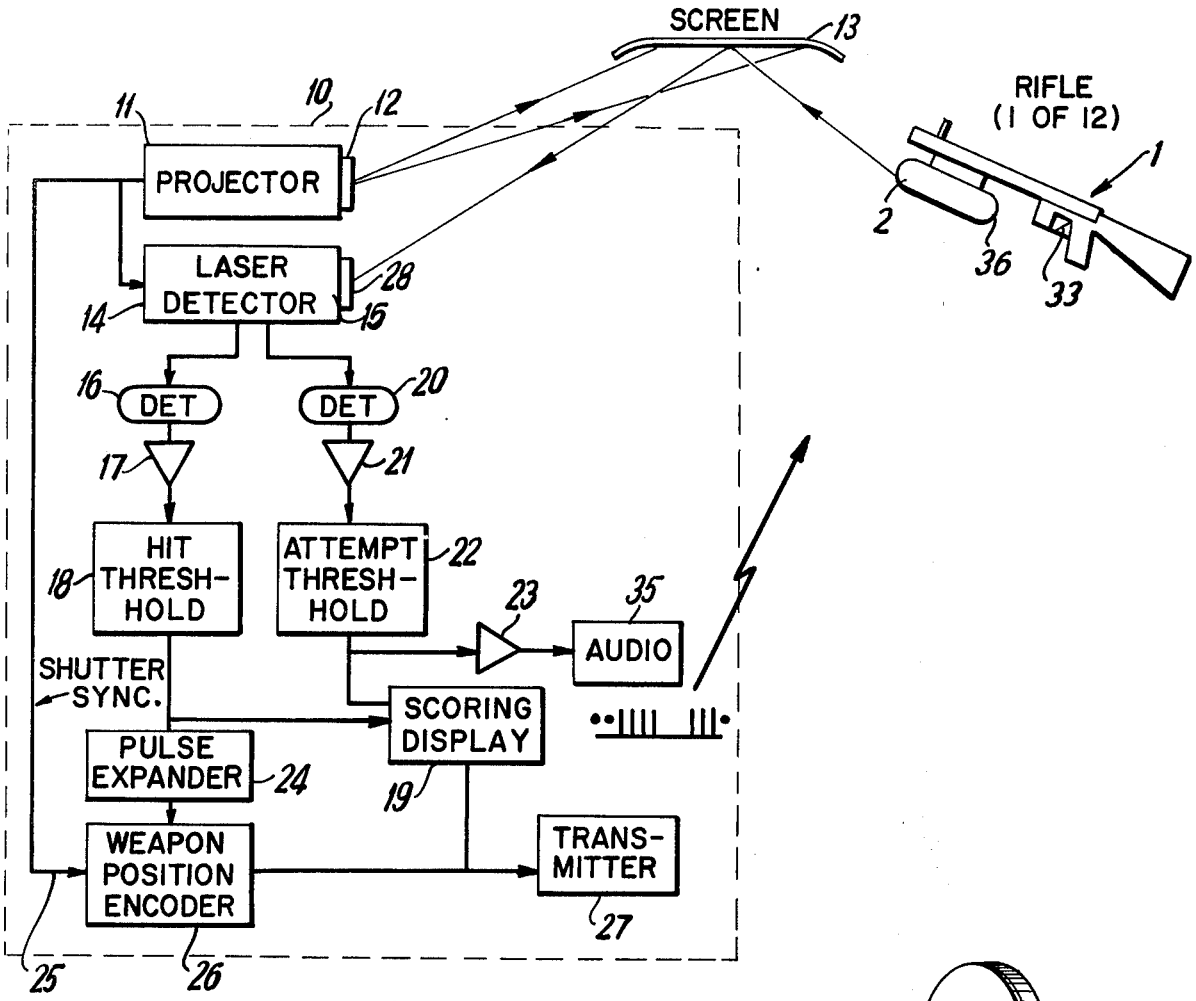
FIG. 1 is a block diagram of the panoramic moving target screen system and illustrates the preferred embodiment of the invention.
Figure 4:
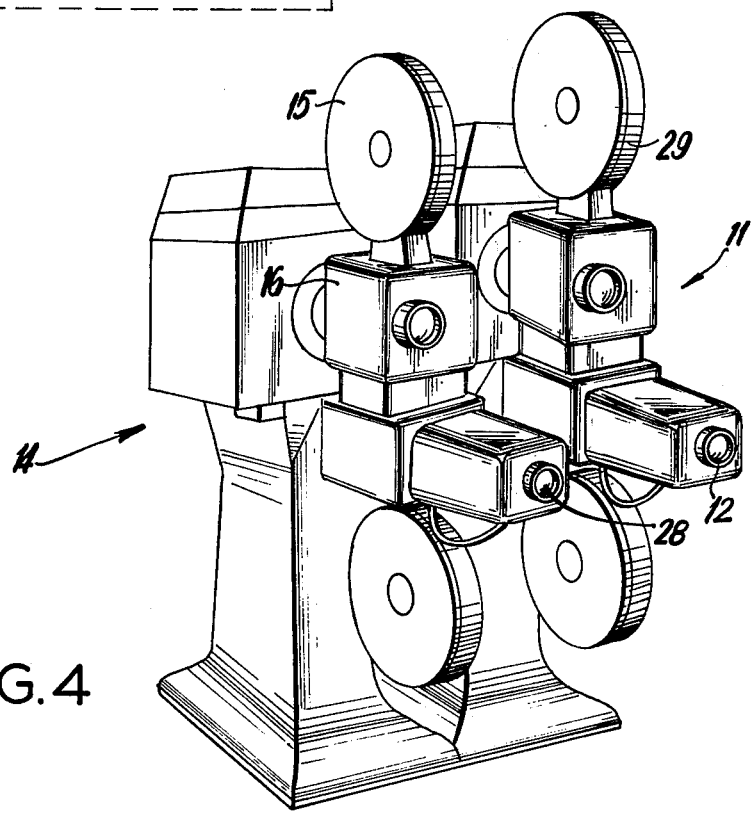
FIG. 4 is a perspective view of the projector and laser detector.

FIG. 1 shows a control console 10 which controls a number of weapon stations, for example, twelve, each of which weapon stations is the same as the other weapon stations.

The weapon 1 shown at the first weapon station may be, for example, an M-16 rifle. A battery-powered laser module 2, having rechargeable batteries, is removably attached to the bayonet fitting of the M-16 rifle or to a like fitting on another weapon.

Figure 3:
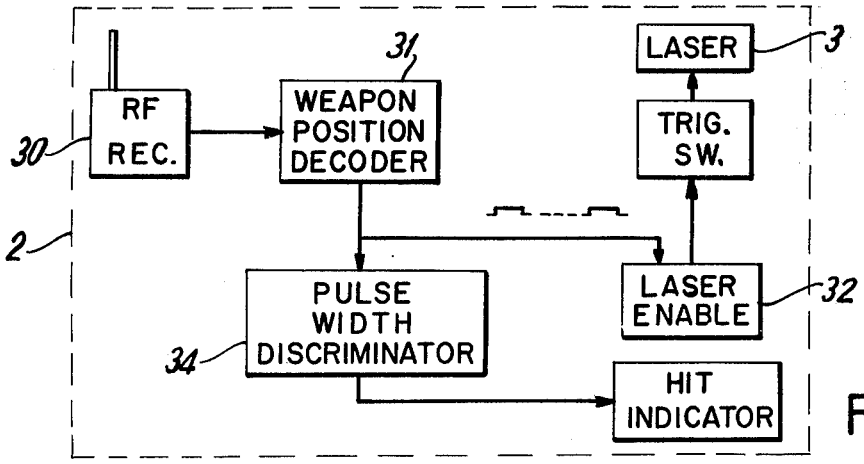
FIG. 3 is a block diagram illustrating the electronic system of the laser module.

As shown in FIG. 3, included in this laser module 2 is a low-power, eye-safe semiconductor laser 3 whose laser beam is aligned with the barrel of the weapon and which simulates the weapon's fire. For example, the laser may be a semiconductor laser diode of Ga-Al-As and may have a wavelength of 0.8$\mu$m with a divergence of approximately 2 mrads and an output of 6 watts in a 100 nanoseconds pulse. The laser module also includes a radio frequency receiver 30 and a weapon position decoder 31 (electronics for decoding and employing the received signal).

As shown in FIG. 1, the system includes control console 10 having a projector 11, which may be an unmodified commercially available 35 mm movie or slide projector using a 2500-watt Xenon bulb. This projector 11 is equipped with an anamorphic adapter lens 12 to allow projection of the target scene onto a curved side screen panoramic screen 13. The anamorphic lens adapter magnifies only in width. A conventional motion picture scene has a ratio of 1.33:1 of width to height and a wide screen using an anamorphic lens has a ratio of 2.66:1. The scene is "taken" using an anamorphic lens in front of the usual lens of the camera, so that the scene fits on 35 mm film. The film 29 is then projected using an anamorphic lens adapter in front of the conventional projection lens. A conventional projection lens has a horizontal field of 40 degrees and the anamorphic lens adapter increases the horizontal field to 67 degrees. The screen may be 10′ × 50′. The wide screen provides a realistic image of a battlefield to as many as 10 men in five two-man frontal parapets (PAR FOX).

When the laser 3 is aimed by the trainee toward a projected target, its beam is reflected by the screen 13 to a laser detector 14 within control console 10. The screen and other equipment may be installed in a semi-fixed non-permanent building such as an air supported structure. The image brightness may be degraded as much as 75% by the split screen optical system of U.S. Pat. No. 3,888,022. The present invention utilizes the full image brightness of its 35 mm projector 11.

Figure 2A:
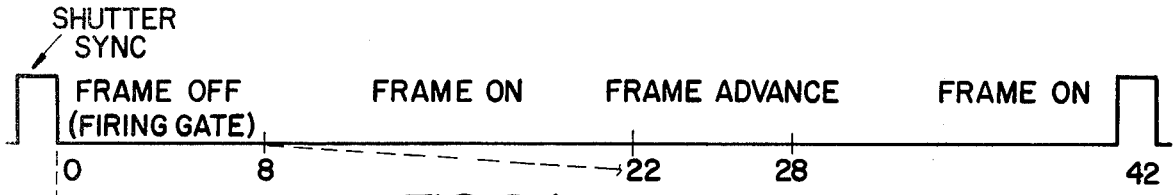

The laser detector 14 may be based upon a commercially available 35 mm movie picture projector or slide projector which is modified for use as a receiver in the present invention. In the case of a modified movie picture projector the laser detector 14 contains an anamorphic lens adapter 28, a receiving lens in the infrared region, and a motion picture film which acts as an annotated mask discriminator 15. The mask discriminator 15 is a motion picture film having an opaque background on which transparent apertures are located at positions corresponding with the locations of the targets as projected by projector 11. In the case of a modified slide projector, the laser detector 14 contains similar annotated slides as masks. The films within the respective projector and laser detector are synchronized on a frame-by-frame exact correspondence by sending simultaneous pulses on line 25 to the commercially available stepping motors (not shown) which drive the two films; the two synchronized films move one frame at a step. The shutter sync pulse is produced by an accurate oscillator within projector 11 and its timing is illustrated in FIG. 2A. Accuracies as to synchronization of 1/6 frame per 400 feet of film have been obtained. The projector 11 and the laser detector (receiver) 14 are aligned side-by-side on the same optical bench.

Figure 2B:
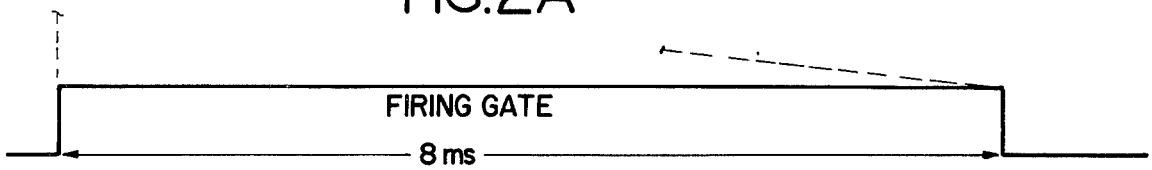
Figure 2C:
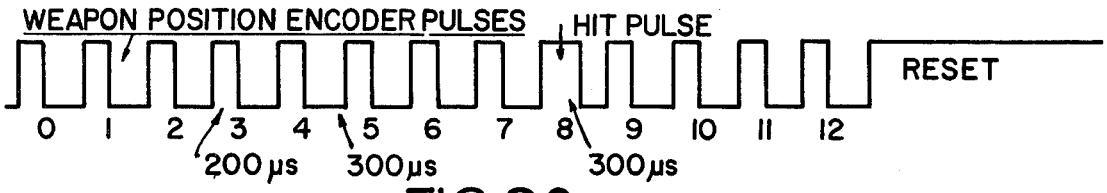
Figure 2D:
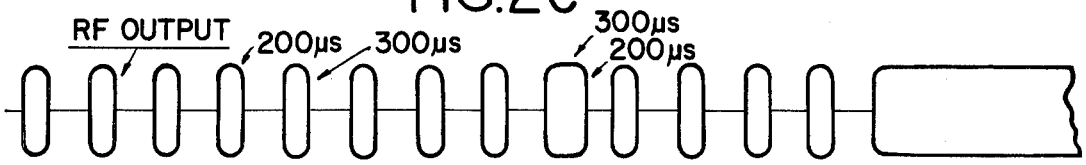
Figure 2E:
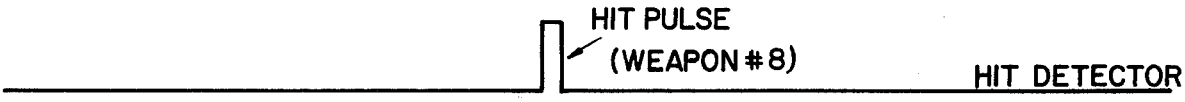

If a target projected on the screen is hit by the laser beam, the beam will be reflected from the screen through an aperture of the mask discriminator 15. The reflected beam, after it passes through the aperture, will activate a hit detector means 16 which is a laser photodetector sensitive to the wavelength of the laser 3. The signal from the detector means 16 is amplified by an amplifier 17 which is connected to a hit threshold circuit 18. If the input to the hit threshold circuit is above a certain predetermined threshold voltage, then a "hit" pulse is sent to the scoring display 19, as shown in FIG. 2E. Also, the "hit" pulse is expanded in time by a pulse expander 24 so as to activate ultimately a light-emitting diode 36 on the weapon 1.

Figure 2F:
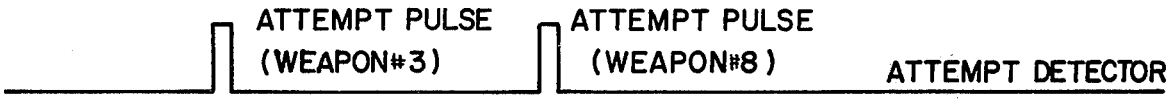
FIG. 2F is two attempt pulses from two specified weapons, by way of example, as detected by the attempt detector of the scoring display.

If the laser beam misses the target, it will be imaged onto the opaque mask and it will be attenuated so as not to register a hit. It will, however, strike a separate attempt detector means 20 which is located so as to view the entire screen. The attempt detector means 20 is a laser beam photo-detector with a wide field of view set at a lower threshold voltage than the hit detector. The attempt detector signal is amplified by amplifier 21, which is connected to an attempt threshold circuit 22. If the signal is above the level of ambient radiation, then an "attempt" pulse is sent to the scoring display 19, see FIG. 2F. A signal from attempt threshold 22 is also sent to an amplifier 23 and then to an audio transducer 35 which emits a "bang" or other noise, adding realistic sound effects to the projected scene.

A detailed embodiment of the scoring display means 19 is discussed in the previously mentioned U.S. Pat. No. 3,888,022 to Pardes et al. The circuitry of the scoring display means 19 is such that a hit pulse must coincide with an attempt pulse in order to register a hit. Such a result is obtained here by synchronizing the scoring display hit counter with the encoder means which are transmitted to the weapon stations. Hence, pulses resulting from spurious ambient radiation will not be scored as hits (see FIGS. 2E and 2F).

Multi-station operation is accomplished by a digitally multiplexed time share system. The system is shown in FIG. 1 and a timing diagram is shown as FIG. 2. Using discrete address techniques, the system permits each laser module to fire only during a specified 200 μsec time (the encoder pulse time) within the 8 msec interval (the "firing gate") between target scene frames, as shown in FIGS. 2A and 2B. The laser is enabled by a code signal transmitted from the weapon position encoder 26. The weapon positioned encoder 26 is synchronized with the projector 11 by means of a connecting cable 25. During the 8 msec firing gate interval a gated oscillator (not shown) within the weapon position encoder 26 produces a rectangular wave (FIG. 2C) from the synchronizing signal input. The rectangular wave output of the weapon position encoder 26 is connected to the scoring display 19, as discussed above, and is also transmitted by the RF transmitter 27 to each of the weapon stations 1 (see FIG. 2D). RF transmission is performed by frequency shift keying, a system which, instead of turning off in the intervals between pulses, changes frequency slightly between pulses so as not to be seen by the receiver. Such a system provides more reliable and noise-immune multiplexing than would pulsed carrier transmission.

Within each laser module 2 is a conventional RF receiver 30, which is connected to the weapon position decoder 31 within the module 2. The input to each weapon position decoder 31 is represented in FIG. 2C. Located within each weapon position decoder is a preset counter (not shown), such as a diode logic circuit, which enables each decoder to recognize the numbered encoder pulse assigned to it. For example, weapon No. 3 will count 4 pulses and weapon No. 8 will count 9 pulses. The counter is preset so as to send a signal to a gate element (not shown) upon receipt of the $(n-1)^{th}$ pulse from the encoder, where the decoder is the $n^{th}$ decoder. If the trigger switch 33 of the weapon 1 is pulled by the weapon operator, a second signal is sent to the gate element. If the signals from the decoder and from the trigger coincide in time, the laser will fire. Detailed discussion of the circuitry of a similar embodiment of the weapon position encoder 26 and decoder 31 will be found in U.S. Pat. No. 3,888,022.

Real-time hit indication is provided to the firer by pulse width discrimination techiques as in U.S. Pat. No. 3,888,022. As shown in FIG. 1, the hit threshold circuit 18 output is connected to the pulse expander 24 (as well as to the scoring display). If there has been a hit, the pulse from the hit detector 16 is broadened in time by a one-shot multivibrator (not shown) to 300 μsec, for example, and is transmitted to the weapon position encoder 26. After decoding by weapon position decoder 31 the expanded width signal enters a pulse width discriminator 34 which is able by the use of a logic circuit to recognize the expanded pulse. The pulse width discriminator enables, through a connecting cable, a hit indicator including a light-emitting diode 36 which is located on the module 2. Thus, a hit is signaled to the operator.

The projector 11 and the laser detector 14 may be aligned relative to each other and the screen by using a laser beam diode built into the projector 11. To align the projector a 45° mirror is removably positioned in front of the film gate of the projector 11. The mirror reflects the laser beam through the optics of the projector onto the screen; for example, the beam may be at the center of a projected image. The laser detector 14 may then be directed toward the screen with a fixed discriminator mask in position. The mask has a transparent area, for example, at its exact center. The laser detector and projector are then moved until the laser beam from the projector passes through the mask's transparent area and registers as a "hit," thereby aligning the projector and laser detector.

What is claimed is:

1. A weapons training system comprising a projection screen, at least one weapon on which is mounted a laser means producing a laser beam which simulates the fire of a weapon and which is controlled by the operator of said weapon to direct said beam at said screen, a projector, a first film within said projector having target scenes, said projector projecting said scenes onto said screen, a laser beam detector positioned adjacent to and spaced from said projector for receiving laser beam radiation reflections from said screen, a second film contained within said detector, said second film being substantially opaque to said radiation reflections from said laser beam except for at least one area which is substantially transparent to said radiation reflections, said transparent area being placed to correspond with a selected target area of said target scene film, said projector and said laser detector having different and independent optical systems each directed at said screen so that the position of the second film corresponds and is aligned with the position of the projection of said target scenes on said screen to define said target area, film driving means, synchronizing means for advancing said first film synchronously with said second film, said synchronizing means including a frame synchronization pulse generator within said projector and means applying pulses from said generator to said film driving means, and hit detector means within said laser beam detector responsive to said reflections of said laser beam from said screen and through said transparent area of said second film.

2. A weapons training system as in claim 1 wherein said projector is a motion picture projector and said first film is a moving picture film showing moving target scenes and said second film is a motion picture film.

3. A weapon training system according to claim 2 wherein said first moving picture film is color film and said second moving picture film is black-and-white film.

4. A weapon training system according to claim 1 wherein said hit detector means is a laser photo-detector and the second film is positioned between the photo-detector and the screen.

5. A weapon training system according to claim 1 and further including a wide-angle attempt detector means responsive to the reflection of said laser beam reflected from any part of said screen, whereby any laser beam incident on said screen will be indicated to the operator as an attempt.

6. A weapon training system according to claim 5 and further including scoring display means responsive to the output of said hit detector means and said attempt detector means.

7. A weapons training system according to claim 1 wherein a plurality of weapons are used each bearing a laser means, each weapon having a trigger under control of the operator of the weapon, each of said laser means being a laser module, said system including encoding means for generating synchronizing pulses of repetition rate equal to the projector frame rate, an R-F transmitter.

each laser module including an R-F receiver, a weapon position decoder, responding to one only of said clock pulses to provide a laser enable pulse to the laser of that module, the laser of said module producing a laser beam upon coincidence of pulses from said laser enable pulse and actuation of the weapon trigger.

8. An electro-optical weapon firing training device according to claim 7 wherein said encoder means includes a pulse expander for increasing the width of that clock pulse which occurs coincidentally with a hit pulse from the hit detector and said decoder includes a pulse width discriminator for deriving an output therefrom only in response to said clock pulse of expanded width, a light emitting diode mounted on each module and responding to the output from said pulse width discriminator to indicate to the operator of that weapon that the simulated target area on the screen has been hit by the laser means mounted on that weapon.

9. A weapons training system comprising a curved panoramic projection screen, at least one weapon on which is mounted a laser means producing a laser beam which is a simulation of the fire of said weapon and controlled by the operation of said weapon to direct said beam at said screen, a motion picture projector having an anamorphic projection lens, a first motion picture film within said projector showing target scenes which first film is in color, said projector projecting said target scenes onto said screen, a laser beam detector positioned adjacent to and spaced from said projector for receiving laser beam radiation reflections from said screen, a second motion picture film contained within said detector, said film being black-and-white and substantially opaque to radiation from said laser beam except for at least one area which is substantially transparent to radiation from said laser beam, said area being placed to correspond with a chosen target area of said target scene film, wherein said projector and said laser detector have different and independent optical systems each directed at said screen so that the position of said second film corresponds and is aligned with the position of the projection of said target scenes on said screen to define said target area, film driving means, synchronizing means for advancing said first film synchronously with said second film, said synchronizing means including a frame synchronization pulse generator within said projector and means applying pulses from said generator to said film driving means, and hit detector means including a laser beam photo-detector and amplifier, which hit detector is responsive to said reflections of said laser beam from said screen and through the transparent area of said second film.

* * * * *